United States Patent [19]

Seebacher

[11] 3,934,058

[45] Jan. 20, 1976

[54] METHOD OF STABILIZING THE HOT RESISTANCE OF CERAMIC POSITIVE TEMPERATURE COEFFICIENT RESISTORS

[75] Inventor: Baerbel Seebacher, Munich, Germany

[73] Assignee: Siemens Aktiengesellschaft, Berlin & Munich, Germany

[22] Filed: June 13, 1974

[21] Appl. No.: 478,855

[30] Foreign Application Priority Data

June 18, 1973 Germany ..... 2330908

[52] U.S. Cl. ..... 427/89; 29/610; 29/611; 29/612; 29/621; 338/22; 252/520; 252/521; 427/103; 427/125; 427/383

[51] Int. Cl.[2] ..... B05D 5/12

[58] Field of Search ..... 117/227, 217, 62; 29/610, 29/611, 612, 621; 338/22; 252/520, 521; 427/89, 103, 125, 383

[56] References Cited

UNITED STATES PATENTS

| | | | |
|---|---|---|---|
| 3,037,180 | 5/1962 | Linz, Jr. | 29/621 |
| 3,258,434 | 6/1966 | Mackenzie et al. | 338/22 SD |
| 3,449,824 | 6/1969 | Heilmeier | 29/610 X |
| 3,754,987 | 8/1973 | Purdes | 29/610 X |

FOREIGN PATENTS OR APPLICATIONS

| | | |
|---|---|---|
| 1,490,713 | 12/1972 | Germany |

*Primary Examiner*—Mayer Weinblatt
*Attorney, Agent, or Firm*—Hill, Gross, Simpson, Van Santen, Steadman, Chiara & Simpson

[57] ABSTRACT

The hot resistance of ceramic positive temperature coefficient resistors is stabilized by subjecting such resistors to a heat treatment over a period of time ranging from 1 to 40 hours at a temperature in the range of 400° to 500° C., either during or after the application of contact coatings on the resistor.

3 Claims, 3 Drawing Figures

550°C
500°C
450°C
400°C
300°C
$10^2$
10
1
$R_H/R_{Ho}$
10
20
30
40
h
t

500°C
450°C
400°C
$10^2$
10
1
$R_H/R_{Ho}$
2
4
6
8
h
t $10^5$
Ω
$10^4$
$10^3$
$10^2$
10
1
R
50
100
150
°C
T

METHOD OF STABILIZING THE HOT RESISTANCE OF CERAMIC POSITIVE TEMPERATURE COEFFICIENT RESISTORS

BACKGROUND OF THE INVENTION

1. Field of the Invention

The present invention relates to ceramic positive temperature coefficient resistors and somewhat more particularly to a method of stabilizing the hot resistance of such resistors.

2. Prior Art

German Pat. No. 1,490,713 discloses ceramic positive temperature coefficient resistors having non-blocking heat applied contact coatings thereon. It is suggested therein that contact coatings be provided by applying a thin film of indium or indium-gallium onto a surface of the ceramic body, then applying a heatable silver preparation onto the thin film and then heating the resultant structure in an oxidizing atmosphere to adhere, burn-in or sinter the contact coatings onto the ceramic body.

However, it has been discovered that with certain specific types of positive temperature coefficient resistor materials, the hot resistance of resistors composed of such materials attains only about 0.3 to 3% of the value such resistors exhibit when just the indium or indium-gallium film was applied. As used herein, the term "hot resistance" will be understood to refer to the maximum resistance of a positive temperature coefficient resistor above the Curie temperature thereof.

A reduction of the hot resistance of a positive temperature coefficient resistor decreases the high increase in resistance required at temperatures above the Curie temperature of the resistor. Accordingly, it would be highly desirable to avoid a reduction in the hot resistance of a resistor.

SUMMARY OF THE INVENTION

The invention provides a method of substantially eliminating any reduction in the hot resistance of a positive temperature coefficient resistor.

In accordance with the principles of the invention, stabilization of the hot resistance of ceramic positive temperature coefficient resistors is attained by subjecting such resistors to heat treatment over a period of time ranging from 1 to 40 hours at a temperature in the range of 400° to 500° C. either during or after the application of contact coatings onto such resistors.

DESCRIPTION OF THE PREFERRED EMBODIMENTS

The invention provides a method of stabilizing the hot resistance of ceramic positive temperature coefficient resistance and eliminating the reduction of the hot resistance of cold conductors (i.e., temperature sensitive resistors) having silver contacts on an indium or indium-gallium layer by subjecting such cold conductors to a heat treatment during or after the burning-in or stoving process.

In a preferred embodiment of the invention, the hot resistance of a ceramic positive temperature coefficient resistor composed of a barium titanate based ferroelectric material having a Perowskite structure and being appropriately doped to render it semiconductive and having non-blocking contact coatings thereon, which are predominantly composed of silver on a thin film of an indium material, such as indium or indium-gallium, is stabilized by subjecting such resistor to a heat treatment over a period of time ranging from 1 to 40 hours at temperatures in the range of 400° to 500° C., at least after the application of the contact coatings. In certain embodiments, the heat treatment comprises subjecting positive temperature coefficient resistors to a heat treatment over a period of time ranging from 10 to 20 hours at a temperature in the range of 400° to 500° C. after application of the non-blocking contact coatings to the resistor. Other embodiments of the invention comprise subjecting the positive temperature coefficient resistor to a heat treatment over a period of time ranging from 2 to 4 hours at a temperature in the range of 400° to 500° C. substantially simultaneously with the application of the non-blocking contact coatings to the resistor.

The invention also provides a ceramic positive temperature coefficient resistor composed of a barium titanate based ferroelectric material having a Perowskite structure which is doped so as to render it semiconductive, which resistor is provided with non-blocking contact coatings comprised predominantly of silver applied on a thin film of an indium material directly on the surface of the ferroelectric material which ceramic resistor is characterized by a stable hot resistance virtually equal to the hot resistance of a substantially similar resistor without silver on the contact coating thereof.

With the foregoing general discussion in mind, a number of detailed examples are presented to illustrate to those skilled in the art the manner in which the invention may be practiced. However, the examples are not to be construed as limiting the scope of the invention in any way.

EXAMPLE I

Figure 1:
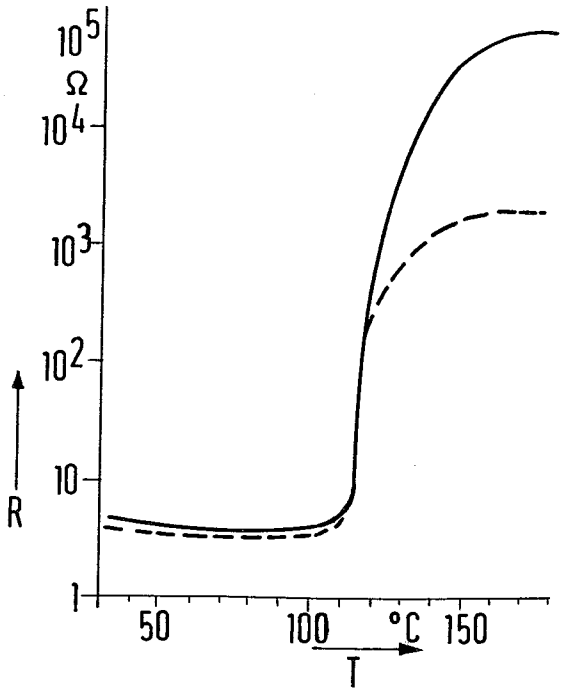
FIG. 1 is a graphical illustration comparing the resistance characteristics of a positive temperature coefficient resistor having an indium-gallium contact thereon and that of a similar resistor having a sintered silver contact.

Positive temperature coefficient resistor discs composed of an antimony doped barium titanate compound having a Curie temperature of 120° C. and having a diameter of 8 mm and a thickness of 0.5 mm were provided in a known manner with an indium-gallium contact. The resistance-temperature characteristic of these resistors were measured and the solid-line curve at FIG. 1 illustrates these results. Thereafter, a commercially available silver preparation suitable for sintering was applied onto the indium-gallium film and heated, stoved or sintered for 12 to 15 minutes at 530° C. The resistance-temperature characteristic of these resistors were measured and the broken-line curve at FIG. 1 illustrates the results. As is readily apparent from FIG. 1, the hot resistance of the silver-coated positive temperature coefficient resistance is less by a factor of more than 10 while the cold resistance remains unchanged in relation to that of the indium material-coated resistors.

Figure 2:
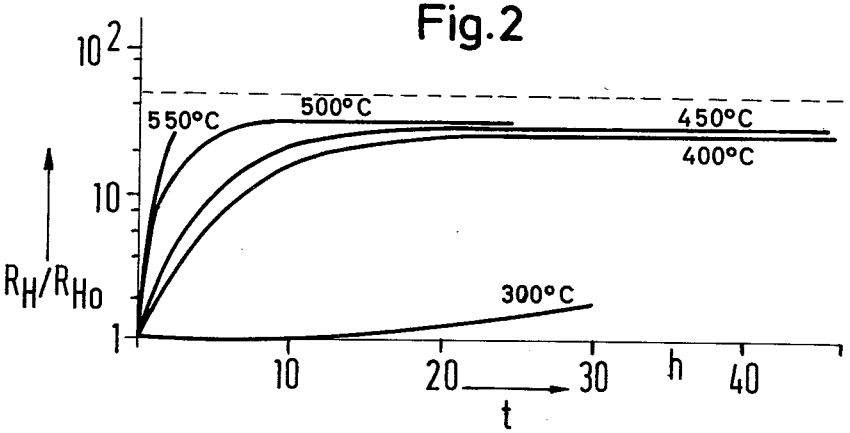
FIG. 2 is a graphical illustration of the increase in hot resistance of positive temperature coefficient resistors after sintering silver thereon, as a function of temperature and time.

The positive temperature coefficient resistors provided with the silver contact were then subjected to heat treatments at various temperatures. The results are illustrated at FIG. 2, which shows how the hot resistance, $R_H$, of the positive temperature coefficient resistor increases as a function of time at different temperatures. The ratio of the hot resistance $R_H$, after heat treatment to the hot resistance, $R_{Ho}$, after the silver sintering process, is shown on the ordinate of the graph of FIG. 2. The broken-line in FIG. 2 illustrates the ratio $R_H/R_{Ho}$ for indium-gallium coated positive temperature coefficient resistors. As is apparent from FIG. 2, an increase in hot resistance by a factor of 20 to 25 is attained, after a heat-treatment over a period of time ranging from 15 to 20 hours at temperatures in the range of 400° to 450° C. A substantially identical increase in hot resistance is also noted after a heat-treatment of only 10 hours at a temperature of 500° C. Accordingly, the invention provides a method of achieving virtually the heat resistance of a positive temperature coefficient resistor which has only been coated with pure indium-gallium. FIG. 2 also illustrates that at temperatures below about 400° C., no appreciable increase in hot resistance is attained (i.e., see the curve for 300° C.). At temperatures above about 500° C., perceptible oxidation of the indium-gallium film takes place and this gives rise to high contact resistances.

EXAMPLE II

Figure 3:
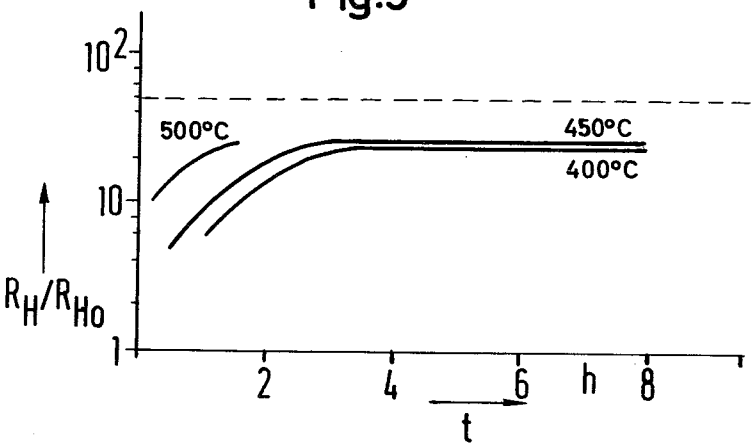
FIG. 3 is a graphical illustration of the relation between hot resistance and the sintering conditions.

Positive temperature coefficient resistors, composed of the same material and having identical dimensions to those in Example I, were provided with indium-gallium and silver contacts in an identical manner to that set forth above and their resistance characteristics were measured. With certain of the positive temperature coefficient resistors, the silver electrodes were applied at different temperatures and different heating periods. FIG. 3 illustrates the ratio $R_H/R_{Ho}$ as a function of time, t, using different heating temperatures as a parameter. As shown, after a heating time, *t*, of 3 to 4 hours at a temperature of 400° to 450° C., an increase in the hot resistance $R_H$, by a factor of 20 to 25 is attained, thus virtually reaching the resistance value of the resistor with only an indium-gallium electrode (illustrated by the broken-line).

While the exact nature of the invention is not fully understood, it is assumed that the heat-treatment of the invention eradicates oxygen gaps in the crystal lattice of the resistors, which may have developed during the silver application process as a consequence of a slight chemical reduction. In other words, it appears that oxygen gaps may produce an additional conductivity and therefor function as a shunt, vis-a-vis the high ohmic grain boundaries, so that the hot resistance is substantially reduced. Further, the principles of the invention may be used to eradicate mechanical stresses from the body of a positive temperature coefficient resistor. As will be appreciated, mechanical stresses may impair the electrical properties of such resistors.

In practical application, the stability of electrical properties is of great importance and accordingly endurance studies were conducted on positive temperature coefficient resistors which had been treated in accordance with the principles of the invention.

In one series of studies, storage of the resistors at elevated temperatures (i.e., about 150° C.) was considered in order to determine the possible formation of intermediate films, which create high contact resistances and would lead to fluctuations in the cold resistance characteristic. After a storage period of 4000 hours, no change or variation in the cold resistance value of treated resistors were noted.

In another series of studies, changes of electrical properties caused by chemical modifications due to ion transfers were considered. In these studies, positive temperature coefficient resistors which had been treated in accordance with the principles of the invention were subjected to an endurance test at a DC density of 0.5 A/cm². After a test period of 4000 hours, no modifications in the cold or hot resistance value of these resistors were detectable.

As demonstrated by the foregoing studies, the resistance increase achieved by the principles of the invention are due to genuine changes in the conductivity of the ceramic.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appendant claims.

I claim as my invention:

1. A method of stabilizing the hot resistance of a ceramic positive temperature coefficient resistor consisting of a barium titanate based ferroelectric material having a Perowskite structure which is doped so as to render in semiconductive, said resistor being provided with non-blocking contact coatings comprised predominantly of silver applied on a thin film of an indium material selected from the group consisting of indium and indium-gallium comprising:

subjecting said positive temperature coefficient resistor to a heat-treatment over a period of time ranging from 1 to 40 hours at a temperature in the range of 400° to 500° C., said heat-treatment occurring at least after the application of said non-blocking contact coatings.

2. A method as defined in claim 1, wherein said positive temperature coefficient resistor is subjected to a heat-treatment over a period of time ranging from 10 to 20 hours at a temperature in the range of 400° to 500° C. after application of the non-blocking contact coatings to said resistor.

3. A method as defined in claim 1, wherein said positive temperature coefficient resistor is subjected to a heat-treatment over a period of time ranging from 2 to 4 hours at a temperature in the range of 400° to 500° C. substantially simultaneously with the application of the non-blocking contact coatings to said resistor.

* * * * *